United States Patent [19]

Frumerman et al.

[11] 4,175,929

[45] Nov. 27, 1979

[54] PROCESS FOR CONTROL OF POLLUTANTS GENERATED DURING COAL GASIFICATION

[75] Inventors: Robert Frumerman, Pittsburgh; Harold M. Hooper, Sewickley, both of Pa.

[73] Assignee: The United States of America as represented by the United States Department of Energy, Washington, D.C.

[21] Appl. No.: 937,903

[22] Filed: Aug. 29, 1978

[51] Int. Cl.[2] ..... C10J 3/16

[52] U.S. Cl. ..... 48/202; 48/203

[58] Field of Search ..... 48/209, 210, 202, 203, 48/206, 197 R; 252/373

[56] References Cited

U.S. PATENT DOCUMENTS

| | | | |
|---|---|---|---|
| 1,426,159 | 8/1922 | Doherty | 48/202 |
| 2,067,029 | 6/1937 | Van Ackeren | 48/206 |
| 2,190,293 | 2/1940 | Malkomes | 48/202 |
| 2,595,234 | 5/1952 | Dubois-Eastman | 48/202 |
| 2,657,124 | 10/1953 | Gaucher | 48/197 R |
| 2,729,552 | 1/1956 | Nelson et al. | 48/210 |
| 2,838,388 | 6/1958 | Carkeck et al. | 48/206 |
| 2,925,335 | 2/1960 | Donath | 48/206 |
| 2,987,387 | 6/1961 | Carkeek | 48/197 R |
| 3,844,733 | 10/1974 | Donath | 48/210 |
| 3,874,116 | 4/1975 | White | 48/206 |
| 3,907,519 | 9/1975 | Sieg et al. | 48/202 |
| 3,920,417 | 11/1975 | Fernandes | 48/197 R |
| 3,963,457 | 6/1976 | Hess | 48/202 |
| 4,031,030 | 6/1977 | Rudolph | 48/202 |
| 4,039,392 | 8/1977 | Singh | 48/202 |
| 4,049,570 | 9/1977 | Gernhardt et al. | 48/206 |

FOREIGN PATENT DOCUMENTS

| | | | |
|---|---|---|---|
| 1333979 | 10/1973 | United Kingdom | 252/373 |

*Primary Examiner*—S. Leon Bashore
*Assistant Examiner*—Mike Goldman
*Attorney, Agent, or Firm*—Dean E. Carlson; Stephen D. Hamel; Earl L. Larcher

[57] ABSTRACT

The present invention is directed to an improvement in the coal gasification process that effectively eliminates substantially all of the environmental pollutants contained in the producer gas. The raw producer gas is passed through a two-stage water scrubbing arrangement with the tars being condensed essentially water-free in the first stage and lower boiling condensables, including pollutant laden water, being removed in the second stage. The pollutant-laden water is introduced into an evaporator in which about 95 percent of the water is vaporized and introduced as steam into the gas producer. The condensed tars are combusted and the resulting products of combustion are admixed with the pollutant-containing water residue from the evaporator and introduced into the gas producer.

6 Claims, 1 Drawing Figure

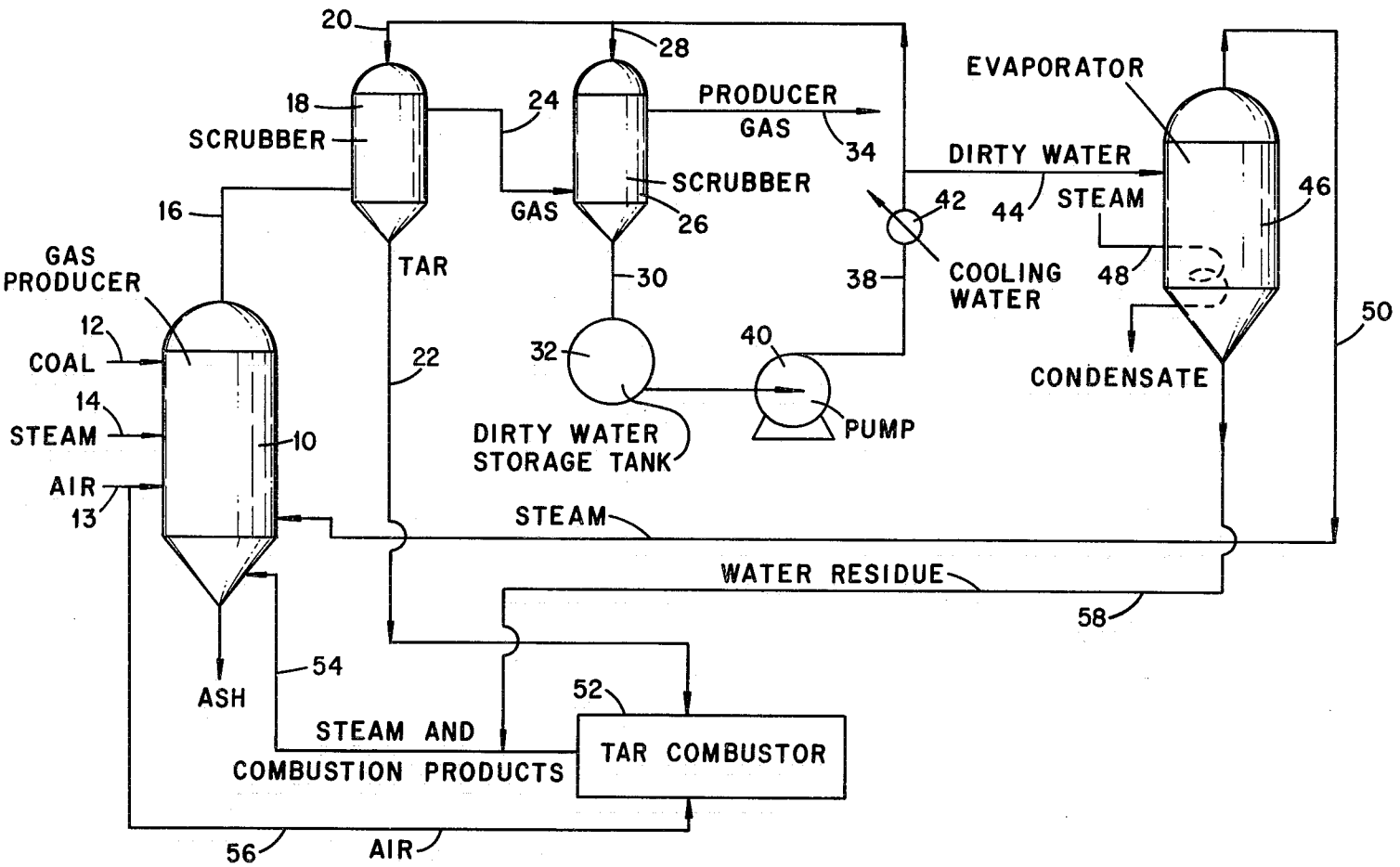
EVAPORATOR
DIRTY WATER
STEAM
CONDENSATE
COOLING WATER
PRODUCER GAS
SCRUBBER
PUMP
DIRTY WATER STORAGE TANK
WATER RESIDUE
TAR COMBUSTOR
STEAM
GAS
TAR
SCRUBBER
STEAM AND COMBUSTION PRODUCTS
AIR
ASH
GAS PRODUCER
COAL
STEAM
AIR
10
12
13
14
16
18
20
22
24
26
28
30
32
34
38
40
42
44
46
48
50
52
54
56
58

PROCESS FOR CONTROL OF POLLUTANTS GENERATED DURING COAL GASIFICATION

This invention was made during the course of, or under, a contract with the U.S. Department of Energy.

BACKGROUND OF THE INVENTION

This invention relates generally to a coal gasification process for producing synthesis gas and, more particularly, to an improvement in the process for treating the raw producer gas from the gasifier to effect the removal of pollutants therefrom and the subsequent elimination of these pollutants by reintroducing them into the gasifier.

The production of synthetic or fuel gas from the solid carbonaceous fuels, especially coal in the form of anthracite, bituminous, lignite or peat, has been utilized for a considerable period of time and has recently undergone significant improvements due to the increased energy demand. Fuel gas may be produced by heating coal with reactive gases, such as air or oxygen, in the presence of steam in a gasification zone to obtain the fuel gas which is withdrawn from the gasification zone and subjected to several cleansing operations to rid it of various contaminants which are formed or liberated from the coal during the gasification operation. These contaminants can readily become environmental pollutants if not properly treated during the gasification operation. For example, materials often found in the fuel gas or producer gas include tars, light oils, hydrogen sulfide, ammonia, cyanides, phenols, various halogens and particulates in the form of carbon, ash, and coal, as well as trace metals. The extent of the pollutants in the coal is determined by the type of coal and the particular gasification process utilized as well as the operating conditions. In any event, the disposal and control of these pollutants have become major problems in the gasification processes which must be satisfactorily handled in order to make coal gasification a viable process without suffering attendant pollution problems.

As the producer gas is discharged from the gasifier, it is usually subjected to a cooling and cleaning operation involving a scrubbing technique wherein the gas is introduced into a scrubber and contacted with a water spray which cools the gas and condenses such condensables as tar, oil and organics. The initially cooled gas may then be treated to desulfurize the gas prior to utilization of the producer gas. The water used for the scrubbing operation becomes what is commonly known as "dirty water," since it is contaminated with tars, various organic materials, and soluble gases. This dirty water may be subjected to a variety of steps which may include the decantation of the heavy and light portions, the stripping of the water to remove such gases as hydrogen sulfide, ammonia, and also solvent extraction steps to remove the phenols, cyanides and the other inorganic anions, such as the halogens. This water after such treatment still contains a considerable amount of materials, especially organics, which must be disposed of or somehow handled without creating an environmental pollution problem. The common practice is to use a containment pond or other disposal or containment areas for the dirty water. However, such disposal techniques have many pitfalls due to the high chemical oxygen demand of the water and the possibility of the material entering the water table or presenting other ecological polluting problems such as invading surface waters.

SUMMARY OF THE INVENTION

It is the primary aim or objective of the present invention to provide an improvement in the gasification process wherein the pollutants generated during the coal gasification and entrained in the production gases are treated and recycled or reintroduced into the gas producer for the combustion of the combustible pollutants and the formation of the non-combustible pollutants in the ash generated in the gas producer so as to effectively eliminate them as environmental pollution sources. This goal is achieved in a gasification process by the steps which comprise the heating and reacting of the coal with reactive gases and steam in a gasification chamber to obtain the pollutant-laden producer gas which is withdrawn from the gasification chamber and introduced into the first of two gas scrubbing or condensing zones. The producer gas is contacted with water in the first condensing zone at a temperature above the aqueous dew point to evaporate the water and condense the tars in the producer gas. These resulting essentially water-free liquid tars are conveyed into a further combustion zone where the tars are burned with the resulting products of combustion being reintroduced into the gasification chamber for permitting the full recovery of the heating value from the tars. The tar-free producer gas is then conveyed into the second condensing zone where the producer gas is again contacted with water to further cool the combustion gases to about ambient temperature for condensing essentially all of the condensable materials remaining in the producer gas. The resulting mixture of water and condensed material, i.e. dirty water, is then conveyed to an evaporation zone where the mixture is heated to a temperature sufficient to evaporate substantially all of the water from the mixture. This water vapor in the form of steam may be introduced into the gasification chamber to provide a portion of the steam requirements for the gasification process. The residue of the dirty water discharged from the evaporation zone may be returned to the gasification chamber by admixing it with the products of combustion emanating from the tar burner. This admixture cools the combustion gases to a temperature necessary for reintroduction into the gasification operation as well as providing a mechanism for eliminating the dirty water residue. This disposal of the water residue is achieved in the combustion zone since most of the materials in the residue will either be revolatilized or form part of the ash which may be readily ecologically disposed of without subjecting the environment to the pollutants which would be present if the dirty water residue was disposed of in liquid form as heretofore practiced.

DESCRIPTION OF THE DRAWING

The accompanying drawing is a flow diagram with appropriate legends illustrating the improved process of the present invention.

DETAILED DESCRIPTION OF THE INVENTION

With reference to the accompanying drawing the gas producer or gasification chamber, as generally shown at 10, may be of any conventional fluidized, or fixed bed type, capable of operating at a pressure in the range of about atmospheric to 1500 psig. Crushed coal of a suitable particle size is introduced into the gas producer 10 through a conduit 12. The combustion supporting medium, such as oxygen or air, is introduced through conduit 13. Steam is admitted into the gas producer through conduit 14 to maintain the temperature within the gas producer below about 1000° C. and preferably in the range of about 350° to 1000° C. The steam also aids in the conversion of carbon and hydrocarbons into useful components of the producer gas, namely hydrogen and carbon monoxide. The raw producer gas generated in the gas producer 10 is discharged through conduit 16 and is usually formed of carbon monoxide, hydrogen, methane and higher hydrocarbons, tar vapors, water vapor, dust, phenols, sulfur compounds, cyanides, and halides, especially chloride and fluoride forms thereof.

The producer gas is conveyed into the first of two gas scrubbing and condensing mechanisms which is generally shown at 18. Water from conduit 20 at a temperature of about 15° to 65° C. is introduced into the scrubber 18 in direct heat exchange with the raw producer gas. This direct heat exchange cools the gas to a temperature in the range of about 100° to 340° C. with the temperature selected being just above the aqueous dew point. During this scrubbing action, the tar vapors are condensed to provide hot liquid tar which is essentially water free. This water-free tar is discharged through conduit 22. As will be described in further detail below, this tar is combusted at a pressure at least as great as in the gas producer 10 and the resulting combustion products are returned to the gas producer 10.

Prior to introducing the raw producer gas into the first gas scrubber 18, it may be desirable to place a cyclone separater, not shown, between the gas producer 10 and the scrubber 18 to remove excess particulate matter so as to prevent a substantial increase in the viscosity of the tars condensed in the scrubber 18.

The producer gas discharged from the gas scrubber 18 through conduit 24 contains the water vaporized in the scrubber 18 and the remaining polluting condensables except for the particulate solid material which would be discharged with the liquid tars. The conduit 24 is coupled to the second scrubber 26 of the two-stage scrubbing system where water from line 28 at the same temperature as that in line 20 contacts the gas entering the scrubber 26 to cool the gas to a temperature near ambient temperature for condensing the non-aqueous materials in the gas. The resulting condensate, or "dirty water," is conveyed via conduit 30 to a suitable storage tank generally shown at 32. The producer gas which is cleansed of the various contaminants, as described above, is discharged from the second scrubber through conduit 34 to a suitable storage facility for subsequent use which may include further treatment, such as methanation, if higher Btu values are desired.

The dirty water from storage tank 32 may be recycled through the scrubbers 18 and 26 by coupling conduit 38 to the storage tank 32 and to the conduits 20 and 28. A pump 40 is placed in conduit 38 for pressurizing the recycle water to the pressure necessary for effecting the scrubbing action. The dirty water in line 38 is preferably cooled in a water cooled indirect heat exchange mechanism generally shown at 42 so as to facilitate the condensation of the pollutants in the scrubbers 18 and 26.

In as much as the raw gas emerging from the gas producer contains some water vapor, the dirty water recycle system, as described above, will contain excess dirty water which may be removed by coupling a conduit 44 to conduit 38 for discharge into an evaporator 46 which is operated at a pressure at least as great as that within the gas producer 10. The evaporator 46 may be heated by a steam heater generally shown at 48 in an indirect heat exchange mode. The evaporator 46 is utilized to evaporate greater than 90 percent, preferably 95 percent of the water from the dirty water. This evaporated water, which is in the form of steam, may be fed into conduit 50 for return to the gas producer 10. This steam feed is highly advantageous to the gasification process since the steam requirements of the gas producer are usually greater than that provided by recycling all of the water evaporated in the evaporator to the gasifier.

The liquid tars discharged from the first evaporator 18 through conduit 22 are led to a tar combuster 52 which is coupled by a conduit 54 to the gas producer 10. Line 56 provides the tar combuster 52 with the necessary combustion supporting medium to burn the tars. If required, an additional fuel component may be introduced into the combuster to aid in the combustion of the tars. By burning the tars and readmitting the resulting combustion products into the gas producer 10, the full heat value of the tars may be utilized in the gasification process. The use of the tar combuster 52 also provides an additional advantage in that the water residue from the evaporator which contains essentially all the condensables from the producer gas may be coupled by line 58 to the conduit 54 downstream of the tar combuster 52 so as to discharge this water residue into the combustion products emanating from the combuster. The water residue cools the combustion products in line 54 to a temperature sufficiently low to allow the combustion products to enter the gas producer without deleterious effects upon the operation of the coal gasification therein. The volatile impurities in the water residue, such as hydrogen, sulfide, phenols, cyanides, halides, etc., which are returned to the gasifier along with the water vapor either flow through the gasifier unchanged, such as in the case of hydrogen sulfide, or they may be decomposed and gasified, such as in the case of the phenols, or accumulated in the ash, as in the case of fluorides. In any event the recycled pollutants from the dirty water are essentially entirely eliminated. Alternatively, instead of mixing the water residue with the combustion products, steam or water such as from the dirty water storage tank 32 may be used to provide the necessary cooling of the combustion products.

It will be seen that the present invention provides a substantial improvement in the gasification process in that it essentially eliminates a great source of pollutants from the environment. The recycling of a water residue as well as the steam generated from the evaporation of the dirty water provides a valuable source of steam for use in the gasification process. The combustion of the tars and the admixture of the resulting combustion products with the water residue provide a mechanism by which the water residue may be disposed of in an ecologically sound manner.

What is claimed is:

1. A process for converting coal into combustible gases wherein environmental pollutants comprising particulate material and non-aqueous condensable material including tars that are generated during the conversion of the coal and entrained in the combustible gases are essentially eliminated as environmental pollutants by the steps of heating the coal in a gasification chamber in the presence of steam and reactive gas to a temperature sufficient to provide the combustible gases, withdrawing the combustible gases from the gasification chamber, contacting the combustible gases with water in a condensing zone at a temperature above the aqueous dew point to evaporate the water and condense tars in the combustible gases, conveying the resulting essentially water-free liquid tars from the condensing zone to a combustion zone operated at pressure at least as great as that in said gasification chamber, burning the tars in the combustion zone, and conveying the products of combustion from the combustion zone into the gasification chamber.

2. The improved process claimed in claim 1, including the additional step of adding moisture to the products of combustion prior to the introduction thereof into the gasification chamber.

3. The improved process claimed in claim 2 including the additional steps of conveying the combustible gases and water vapor from the said condensing zone into a further condensing zone, contacting the combustible gases in said further condensing zone with sufficient water to cool said combustible gases to about ambient temperature for condensing the water vapor and essentially all of the condensable material remaining in the combustible gases, conveying the condensed material and water into an evaporation zone, and heating said condensed material and water in the evaporation zone to a temperature sufficient to evaporate substantially all of the water therefrom.

4. The process claimed in claim 3, wherein the pressure within said evaporation zone is at least as great as that in the gasification chamber, and including the additional step of directing the water vapor from said evaporation zone into the gasification chamber.

5. The process claimed in claim 3 wherein about 95 percent of the water is evaporated in said evaporation zone.

6. The process claimed in claim 4 wherein said step of adding moisture to the products of combustion comprises admixing the condensed non-aqueous condensable material and unvaporized water from said evaporating zone remaining after the heating step with said products of combustion for conveyance therewith into said gasification chamber.

* * * * *